US012448186B2

(12) United States Patent
Wong et al.

(10) Patent No.: US 12,448,186 B2
(45) Date of Patent: Oct. 21, 2025

(54) LID ASSEMBLY WITH SELECTABLE DRINKING OPENINGS

(71) Applicant: AEGIS GLOBAL RESOURCES (HK) LIMITED, Hong Kong (HK)

(72) Inventors: Siu Wah Wong, Hong Kong (HK); Shun Sang Poon, Hong Kong (HK); Fat Sun Kwok, Hong Kong (HK)

(73) Assignee: AEGIS GLOBAL RESOURCES (HK) LIMITED, Hong Kong (HK)

( * ) Notice: Subject to any disclaimer, the term of this patent is extended or adjusted under 35 U.S.C. 154(b) by 91 days.

(21) Appl. No.: 18/242,343

(22) Filed: Sep. 5, 2023

(65) Prior Publication Data

US 2024/0083641 A1 Mar. 14, 2024

Related U.S. Application Data

(60) Provisional application No. 63/412,596, filed on Oct. 3, 2022, provisional application No. 63/404,622, filed on Sep. 8, 2022.

(51) Int. Cl.

| | |
|---|---|
| ***B65D 51/18*** | (2006.01) |
| ***B65D 43/16*** | (2006.01) |
| ***B65D 43/22*** | (2006.01) |
| ***B65D 47/04*** | (2006.01) |
| ***B65D 47/06*** | (2006.01) |

(52) U.S. Cl.

CPC ..... *B65D 51/18* (2013.01); *B65D 43/165* (2013.01); *B65D 43/22* (2013.01); *B65D 47/043* (2013.01); *B65D 47/06* (2013.01); *B65D 2543/00092* (2013.01); *B65D 2543/00231* (2013.01)

(58) Field of Classification Search

CPC ..... B65D 51/18; B65D 43/165; B65D 43/22; B65D 47/043; B65D 47/06; B65D 2543/00092; B65D 2543/00231

See application file for complete search history.

(56) References Cited

U.S. PATENT DOCUMENTS

| | | | | |
|---|---|---|---|---|
| 9,655,463 | B2 * | 5/2017 | Madala | B65D 81/3876 |
| 10,159,368 | B2 * | 12/2018 | Lin | B65D 43/16 |
| 11,577,892 | B2 * | 2/2023 | Wong | B65D 47/061 |
| 2012/0241454 | A1 * | 9/2012 | Dennis | B65D 51/18 220/259.2 |
| 2019/0062006 | A1 * | 2/2019 | Breit | B65D 41/0435 |
| 2022/0402663 | A1 * | 12/2022 | Swartz | B65D 47/065 |

* cited by examiner

*Primary Examiner* — James N Smalley
(74) *Attorney, Agent, or Firm* — WPAT, PC

(57) ABSTRACT

A lid assembly, for a container, comprising: a first lid member; and a second lid member, positioned below said first lid member, is provided with: a first drinking means in direct fluid communication with the beverage in said container via a first fluid passageway, wherein said first lid member pivotably connecting said second lid member to assume a first position where said first drinking means being covered by said first lid member and a second position where said first drinking means being exposed; a second drinking means provided with a drinking tube in fluid communication with the beverage in said container via a second fluid passageway, wherein said second drinking means is configured to operationally enable said second fluid passageway; and characterized in that: the use of said first drinking means and the use of said second drinking means is mutually exclusive and is independent of each other; and said first fluid passageway and said second fluid passageway are independent of each other.

19 Claims, 11 Drawing Sheets

LID ASSEMBLY WITH SELECTABLE DRINKING OPENINGS

FIELD OF THE INVENTION

The present invention relates to a container with selectable drinking openings. In particular, the present invention relates to a lid assembly for a container, the lid assembly has a selectable drinking opening for hot beverages and a selectable drinking opening for cold beverages.

BACKGROUND OF THE INVENTION

There are increasing demands by consumers in the market for better drinking experience in using drinking mug or drinking bottle. For example, a mug or bottle that is suitable for drinking hot and cold beverages, which can satisfy consumers' desire for greater flexibility and customization.

The present invention addresses these issues or at least provides an alternative to the public, providing a lid assembly, for the mug or bottle, offering two selectable drinking openings that provides versatility and customization for the drinking experience. Consumers can choose between two different openings to tailor their drinking experience to their preferences and the type of beverage they are consuming. This feature enhances the enjoyment of the beverage by providing a customized experience. Additionally, the two different openings offer convenience, making it easy to adapt to different scenarios and making it a more convenient choice for on-the-go consumption.

SUMMARY OF INVENTION

The present invention relates to a lid assembly, for a container, comprising: a first lid member; and a second lid member, positioned below said first lid member, is provided with: a first drinking means in direct fluid communication with the beverage in said container via a first fluid passageway, wherein said first lid member pivotably connecting said second lid member to assume a first position where said first drinking means being covered by said first lid member and a second position where said first drinking means being exposed; a second drinking means provided with a drinking tube in fluid communication with the beverage in said container via a second fluid passageway, wherein said second drinking means is configured to operationally enable said second fluid passageway; and characterized in that the use of said first drinking means and the use of said second drinking means is mutually exclusive and independent of each other; and said first fluid passageway and said second fluid passageway are independent of each other.

In one preferred embodiment, said second lid member comprising: a lower lid contacting said container, wherein said second drinking means is provided on said lower lid; and an upper lid, positioned below said first lid member and above said lower lid, wherein said first drinking means is provided on said upper lid, and said upper lid pivotably connecting said lower lid to assume a first position where said second drinking means being covered by said upper lid and a second position where said second drinking means being exposed.

Advantageously, said lower lid is provided with a drinking grid thereon, the position of said drinking grid is positioned underlying the position of said first drinking means when said upper lid covering said lower lid.

Advantageously, said lid assembly is provided with a hinge mechanism on the side wall of said lower lid, on which said first lid member and said upper lid are respectively mounted pivotably.

More advantageously, said hinge mechanism comprising a coil spring.

More advantageously, said lid assembly is provided with a lock mechanism with which said hinge mechanism collaborating for controlling the pivotable movement of said first lid member and said upper lid.

Preferably, said lock mechanism comprising: a) a lid latch having: a first lid latch member provided on said first lid member; and a second lid latch member provided on said upper lid; b) a side latch having: a first side latch member and a second side latch member provided on the side wall of said lower lid; and characterized in that, said first side latch member engaging with said first lid latch member to close said upper lid; said second side latch member engaging with said second lid latch member to close said first lid member; said first lid member is opened by disengaging said first lid latch member from said first side latch member; and said first lid member and said upper lid are both opened by disengaging said second lid latch member from said first side latch member.

Selectively, said lock mechanism movable between a locked position where disengagement of said lid latch from the side latch is prevented, and an unlocked position where the disengagement of said lid latch from said side latch is allowed to open said first lid member and said upper lid.

More selectively, said drinking tube extending through said second drinking means defining an upper portion of said drinking tube outwardly exposed and a lower portion of said drinking tube inwardly disposed in contact with the beverage in said container, wherein said upper portion is bendable, characterized in that, the bottom surface of said upper lid is provided with a recessed region sized and shaped to receive said upper portion of said drinking tube when said upper lid is at its first position; and/or the upper surface of said lower lid is provided with a recessed region sized and shaped to receive said upper portion of drinking tube when said upper lid is at its first position.

In another preferred embodiment, said second drinking means is pivotably connected to said second lid member, thereby said second drinking means is configured to assume: a first configuration in which said second drinking means is positioned to block said second fluid passageway; or a second configuration in which said second drinking means is positioned to enable said second fluid passageway.

Advantageously, in said first configuration, said second drinking means is received in a chamber recessed from the upper surface of said second lid member.

Advantageously, said chamber is dimensioned fit to receive said second drinking means, said chamber is formed by: a pair of opposite internal walls extending downwards from the upper surface of said second lid member; a portion of the surrounding wall of said second lid member, and a portion of the bottom of said second lid member.

More advantageously, said lid assembly is provided with a hinge mechanism allowing said first lid member pivotably moving between said first position and said second position.

More advantageously, wherein said lid assembly is provided with a lock mechanism with which said hinge mechanism collaborating for controlling the pivotable movement of said first lid member.

Preferably, said hinge mechanism is an axle passing through a groove and an aperture, wherein: said groove is formed in a standing wall of a recessed region on a part of the perimeter of the top surface of said second lid member; and said aperture is formed in two opposite free ends of an arcuate notch of said first lid member profiled in a ring shape having said arcuate notch.

More preferably, wherein said first lid member profiled in a ring shape, such that a user can use said second drinking means without the need to open said first lid member.

Selectively, said second lid member is designed in that the height of said second lid member gradually increases from its one end adjacent said hinge mechanism to its other end adjacent said first drinking means, thereby said first drinking means is in a position higher than said hinge mechanism.

More selectively, wherein said second drinking means is provided with a handle allowing users to pivotally move said second drinking means from said first configuration to said second configuration.

Advantageously, said handle covering said second drinking means when said second drinking means is in said first configuration.

DESCRIPTION OF THE DRAWINGS

Some embodiments of the present invention will now be explained, with reference to the accompanied drawings, in which:—

DETAILED DESCRIPTION OF PREFERRED EMBODIMENTS OF THE INVENTION

Figure 1:
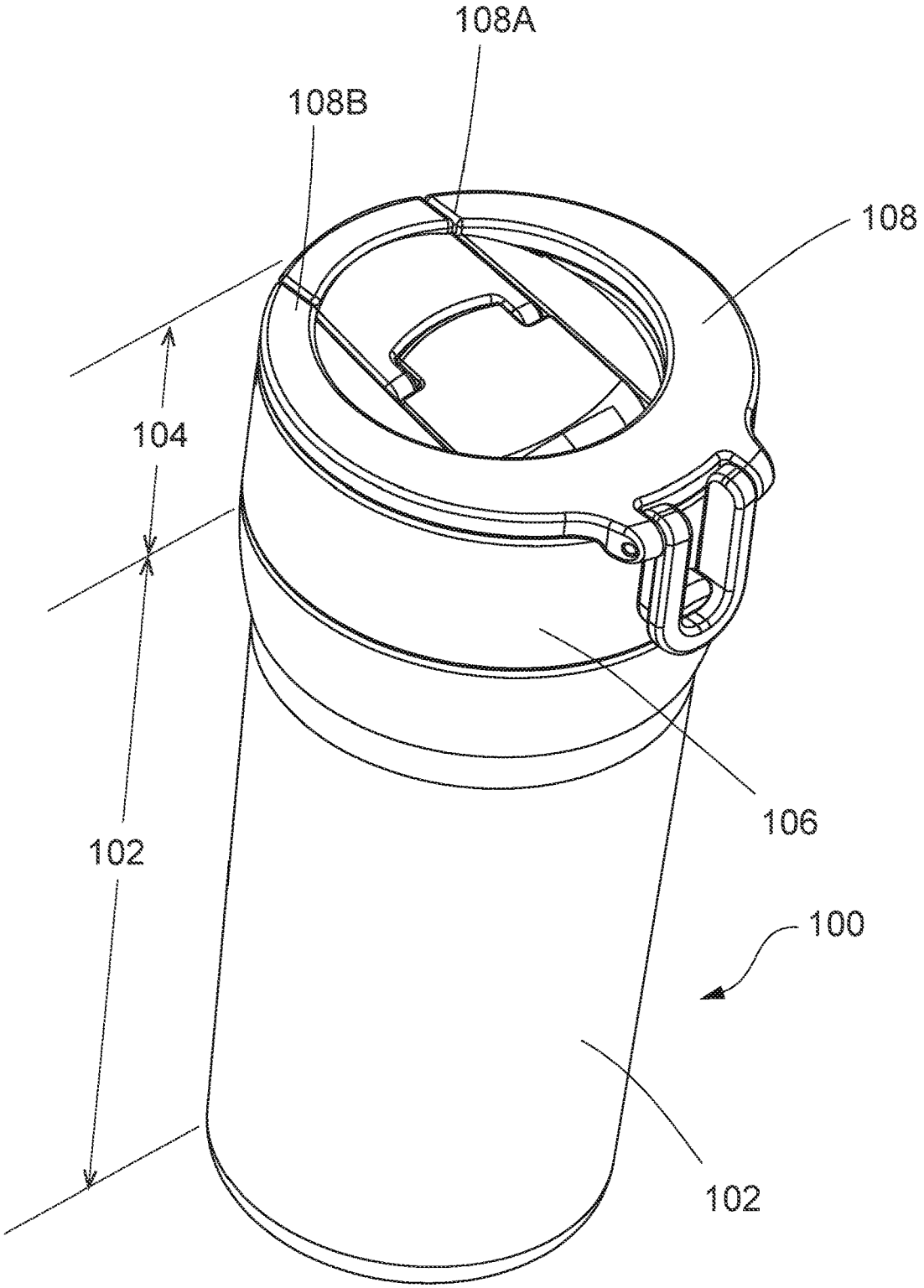
FIG. 1 illustrates a container with a first embodiment of a lid assembly of the present invention.

The present invention is now presented by way of examples with reference to the figures in the following paragraphs. Objects, features, and aspects of the present disclosure are disclosed in or are apparent from the following description. It shall be understood by one of ordinary skilled in the art that the following description is a description of exemplary embodiments only, and is not intended as limiting the broader aspects of the present disclosure, which broader aspects are embodied in the exemplary constructions.

It should be noted that, unless otherwise defined, the technical terms or scientific terms used in the embodiments of the present invention shall have the usual meanings understood by person with ordinary skills in the art to which the present invention belongs. "First", "second" and similar expression used in the embodiments of the present invention do not indicate any order, quantity or importance, but are only used to distinguish different components. "Front", "rear", "left", "right", "upper", and "lower" and other terms indicating orientation or similar terms are only described for the exemplary relative positional relationship shown in the drawings to facilitate the understanding. It does not limit the disclosed components in the present invention can only follow this specific relative positional relationship. "Connect or the like", "mount or the like" or "secure or the like" or "assemble or the like" is not limited to physical or mechanical connections, whether direct or indirect.

FIGS. 1-4 illustrate a first embodiment of a lid assembly of the present invention.

FIG. 1 illustrates that a container 100 comprising a base member 102, a lid assembly 104 on top of the base member 102. The base member 102, for example, is cylindrical in profile and is configured to contain liquid such as water. The cross section, in traverse plane, of the lid assembly 104 is sized and shaped corresponds to the cross section, in traverse plane, of the base member 102, and thus the lid assembly 104 is assembled on top of the base member 102 by common closure means such as screw closure or quick-fit well known in the art. For brevity purpose, the closure means is well understood by those skilled in the art and thus is not explained in details herein.

The lid assembly 104 comprises a lid body 106 and a cover body 108. The cover body 108, for example, is profiled in a ring shape having an arcuate notch, thus the cover body 108 is provided with two opposite ends 108A, 108B at the notch thereof. Said two opposite ends 108A, 108B pivotably engaged with the lid body 106 allows the cover body 108 to move pivotably about an axle. Pivotal engagement between the lid body 106 and the cover body 108 will be described subsequently in greater details. As seen, the substantial central portion of the cover body 108 is hollow, therefore, when the cover body 108 sits on the lid body 106, as illustrated in FIG. 1, the upper surface (or the top surface) of the lid body 106 can be seen by naked eyes.

Figure 2A:
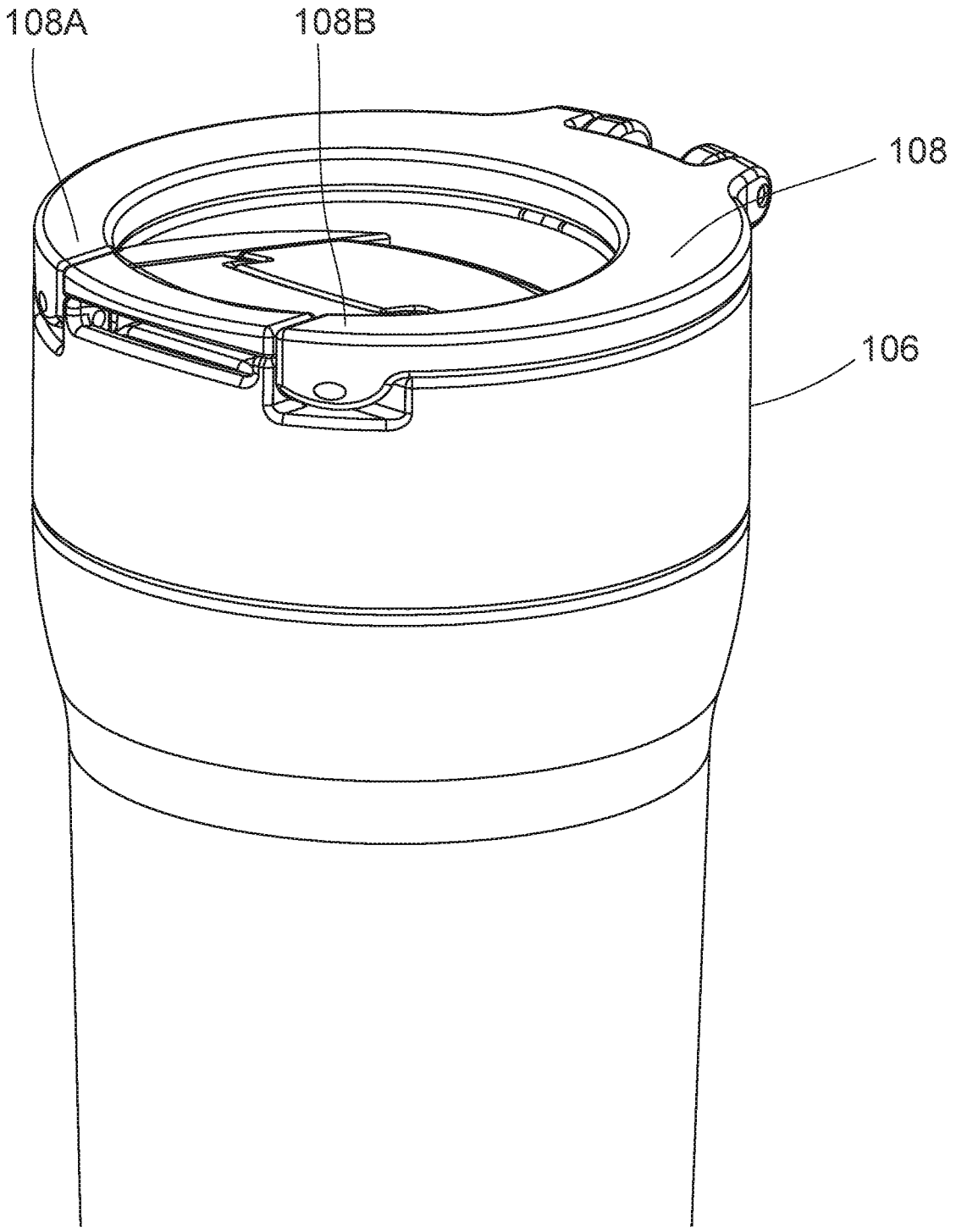
FIGS. 2A-2B illustrate the first embodiment of the lid assembly in a closer view.
Figure 2B:
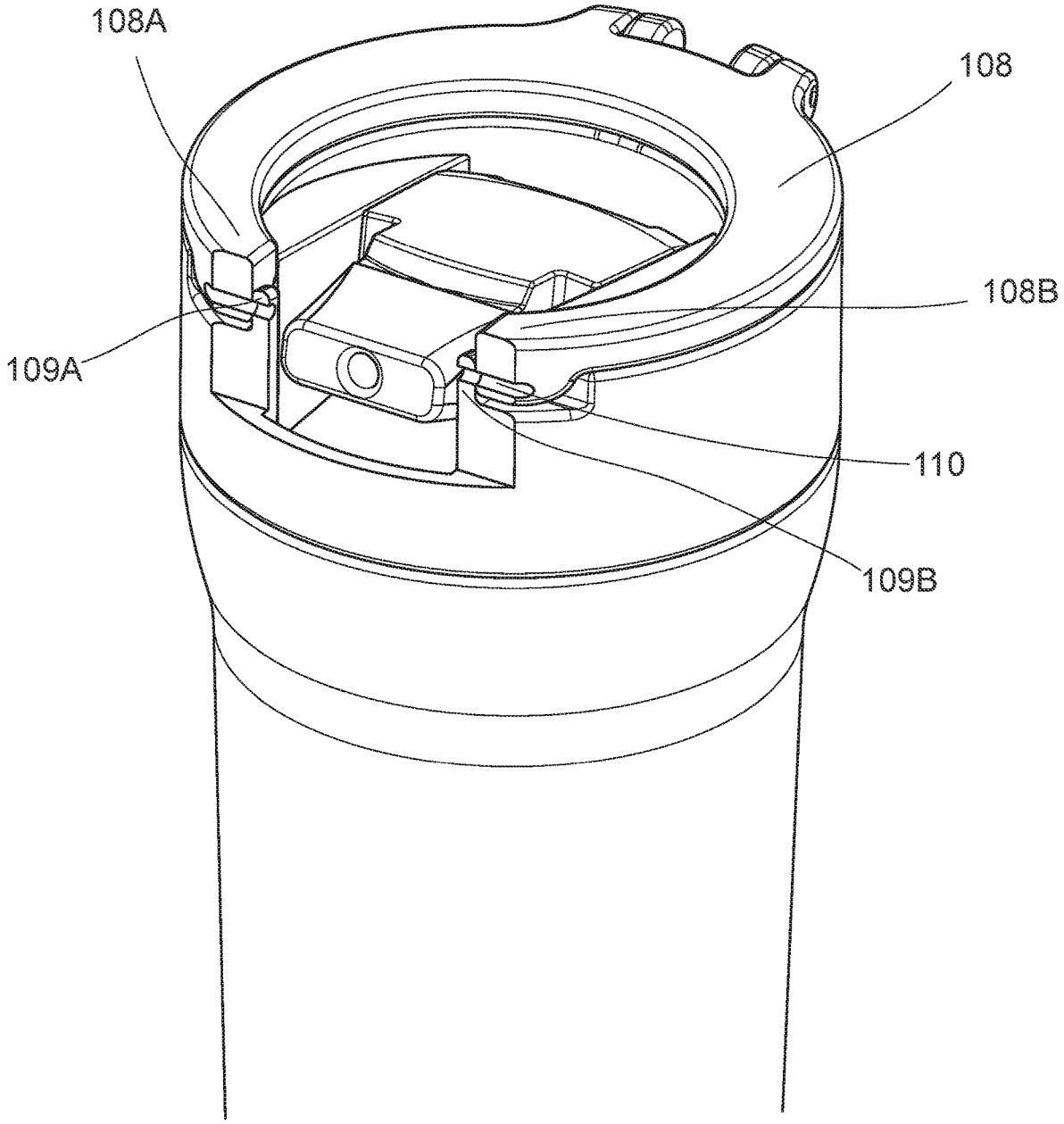

The pivotal movement of the cover body 108 with respect to the lid body 106 can be seen clearly in a closer view of the lid assembly 104 illustrated in FIGS. 2A and 2B. For brevity's sake, FIG. 2B shows the assembly with some parts of the lid body 106 and the cover body 108 remove. Said pivotal movement, for example, is embodied by respective connection between the two opposite ends 108A, 108B and plateaus 109A, 109B. Referring to FIG. 2B, it can be seen that the plateaus 109A and 109B each is a standing wall in a recessed area provided on the perimeter of the top side of the lid body 106, wherein the recessed area is distant from the lock 112. The opposite ends 108A, 108B and plateaus 109A, 109B are internally provided with a groove defining an aperture 110 for receiving an axle (for brevity's sake, the axle is not shown in figures) for allowing the pivotal movement of the cover body 108 with respect to the lid body 106. Advantageously, in a manufacturing process, the axles are metal pins respectively arranged penetrating through the two opposite ends 108A, 108B and plateaus 109A, 109B.

Figure 3A:
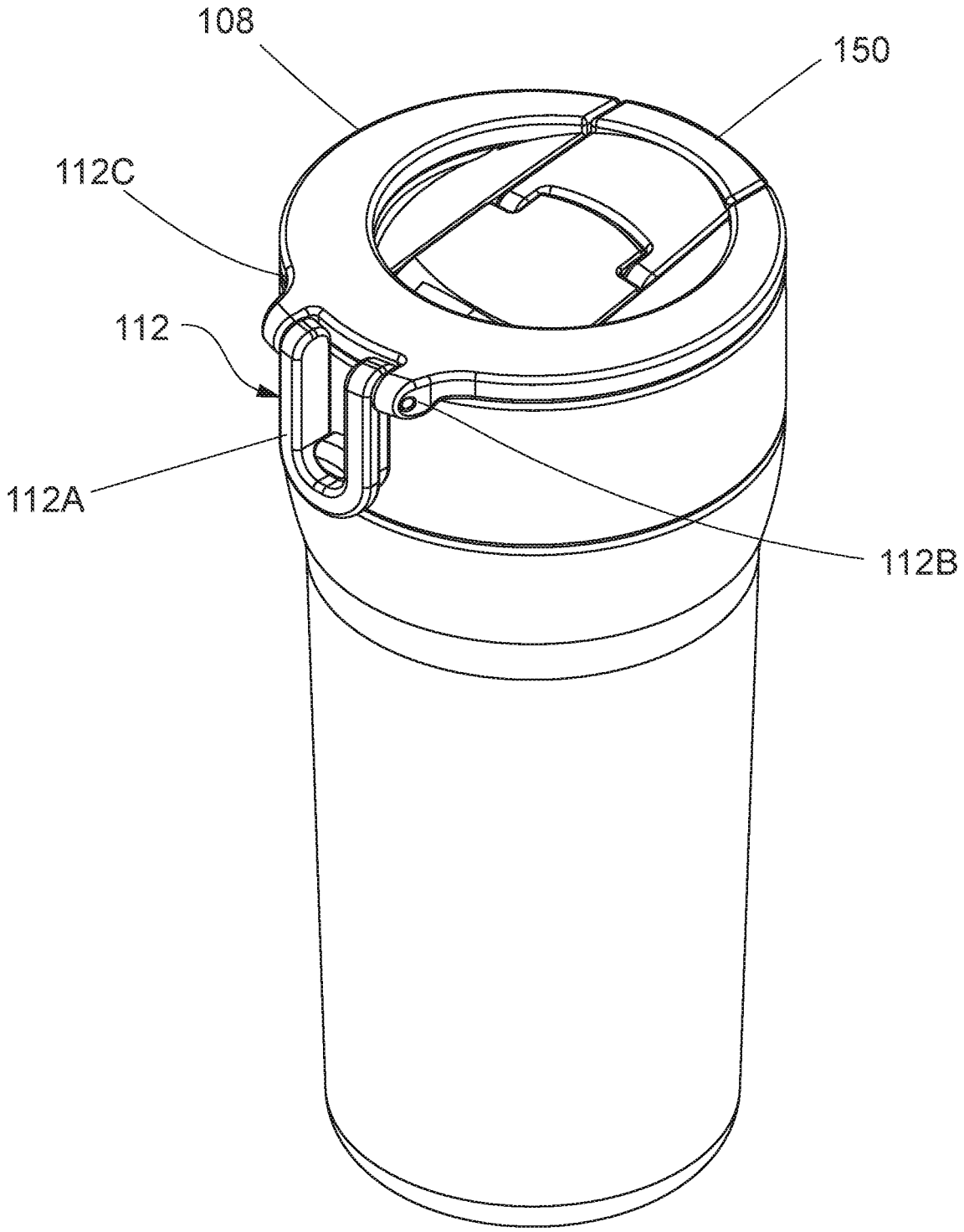
FIG. 3A-3C illustrate the lid assembly is in different configurations.
Figure 3B:
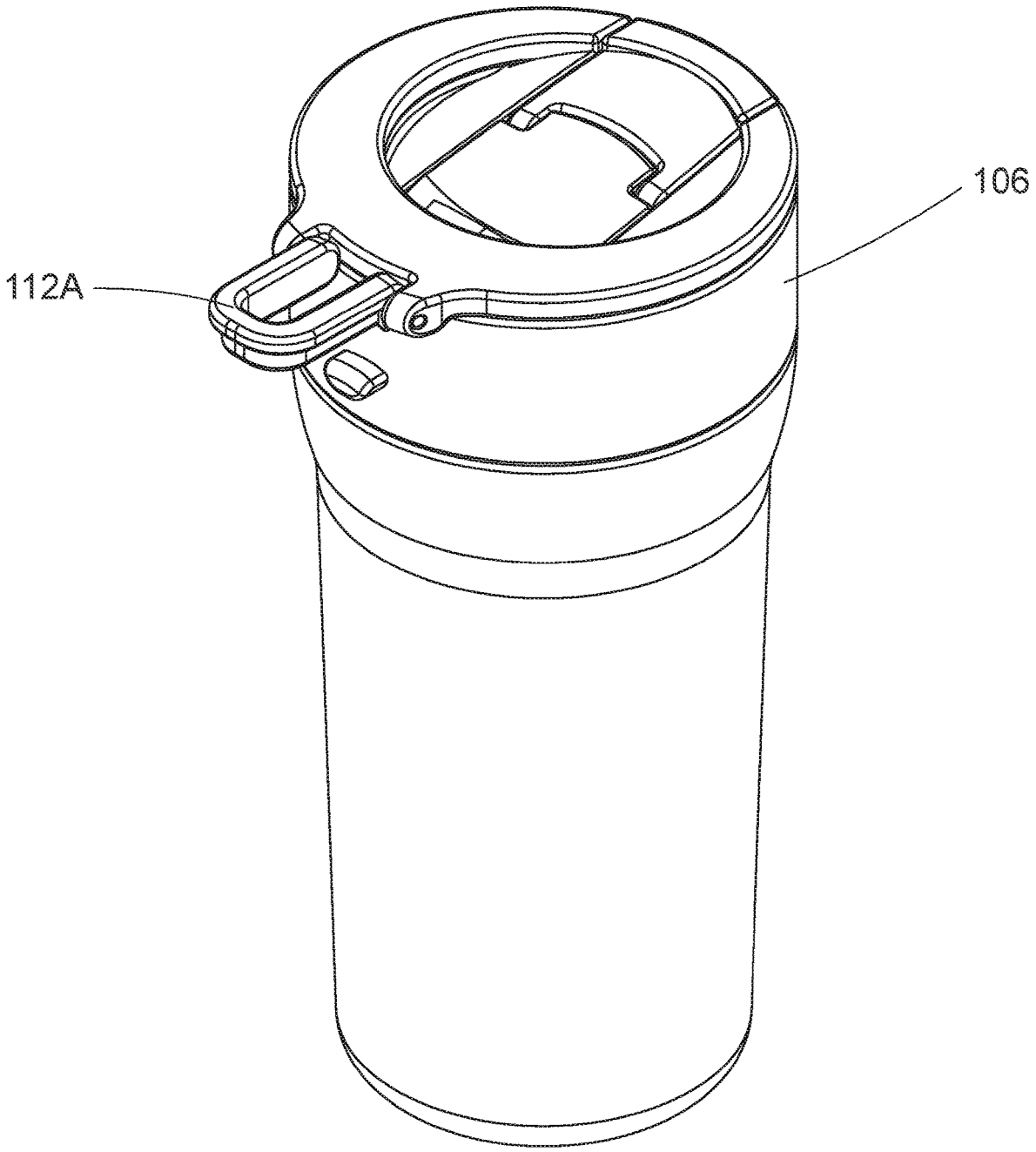
Figure 3C:
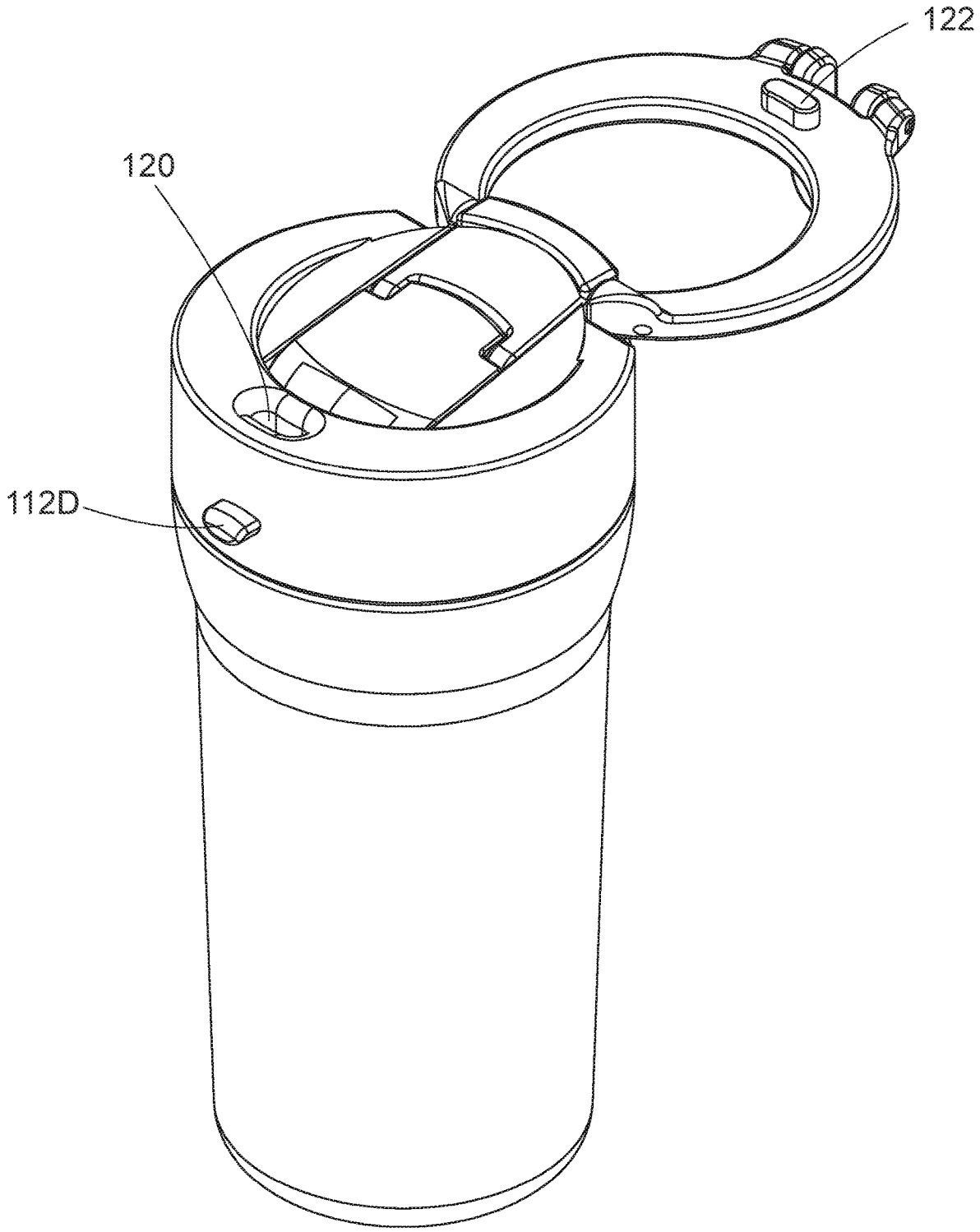

FIG. 3A-C illustrate the lid assembly 104 is in different configurations, in which FIG. 3A illustrates the cover body 108 is locked, FIG. 3B illustrates the cover body 108 is unlocked, and FIG. 3C illustrates the cover body 108 is fully opened Referring to FIG. 3A, it can be seen that a lock 112 is provided to the lid assembly 104. When the lock 112 is open, the cover body 108 is allowed to move away or towards the lid body 106 about the axles penetrating through the two opposite ends 108A, 108B and plateaus 109A, 109B. When the lock 112 is closed, it restricts the movement of the cover body 108 about the axles and the cover body 108 is secured on top of the lid body 106. As an illustrative example in FIGS. 3A and 3B, the lock 112 comprises a tongue 112A pivotably connected to the cover body 108 about axles 112B, 112C, and a hook 112D provided to the outer circumferential wall of the lid body 106.

The operation of the lock 112, for example, can be implemented by an interlocking relationship between the tongue 112A and the hook 112D by hingedly moving the tongue 112A towards the hook 112D about the axles 112B, 112C, when the tongue 112A abuts the hook 112D, the tongue 112A and the hook 112D can be interlocked, for example by snap fitting, by snapping the tongue 112A slightly further against the hook 112D. When the lock 112 is required to be unlocked, it can be implemented by snapping the tongue 112A slightly away from the hook 112D to release the interlocking between the two members, by then the cover body 108 can be moved freely about the axles. Operation of the lock 112 can be referred to FIGS. 3A-C. Advantageously, the tongue 112A or the hook 112D, for example, is prepared with resilient materials, allowing easier the interlocking between the two members.

The lid assembly 104 further comprises an orifice 120, as shown in FIG. 3C which shows that the cover body 108 is opened 180° degrees from its locked configuration. As shown, the orifice 120 is exposed and thus be seen at the edge of the upper surface of the lid body 106. By definition, "upper surface of the lid body" in the context of this aspect of invention refers to the outwardly facing surface of the lid body 106 when the lid body 106 is assembled to the base member 102. Advantageously, the orifice 120 is suitable for drinking hot liquid contained in the base member 102, since the orifice 120 is dimensioned small thus the flow rate of the hot liquid can be controllably adjusted. The orifice 120 is provided with a dispensing system operably connecting the orifice 120 and the internal cavity of the base member 102, allowing user to drink via the orifice 120. For brevity, the dispensing system is well understood by those skilled in the art and thus is not explained in details herein.

FIG. 3C shows that a protrusion 122 is provided on the underside of the cover body 108. By definition, "underside of the cover body" in the context of this aspect of invention refers to the inwardly facing surface of the cover body 108 when the cover body 108 is locked. The position of the protrusion 122 corresponds to the position of the orifice 120. The orifice 120 is sized and shaped fit to receive the protrusion 122, whereby spilling is prevented when users carrying the container 100. Advantageously. the protrusion 122, for example, is prepared in resilient materials.

The lid assembly 104 further comprises a spout 130. The spout 130 is provided with a dispensing system allowing user to drink the beverage in the container via the spout 130. For brevity, the dispensing system is well understood by those skilled in the art and thus is not explained in details herein.

Figure 4A:
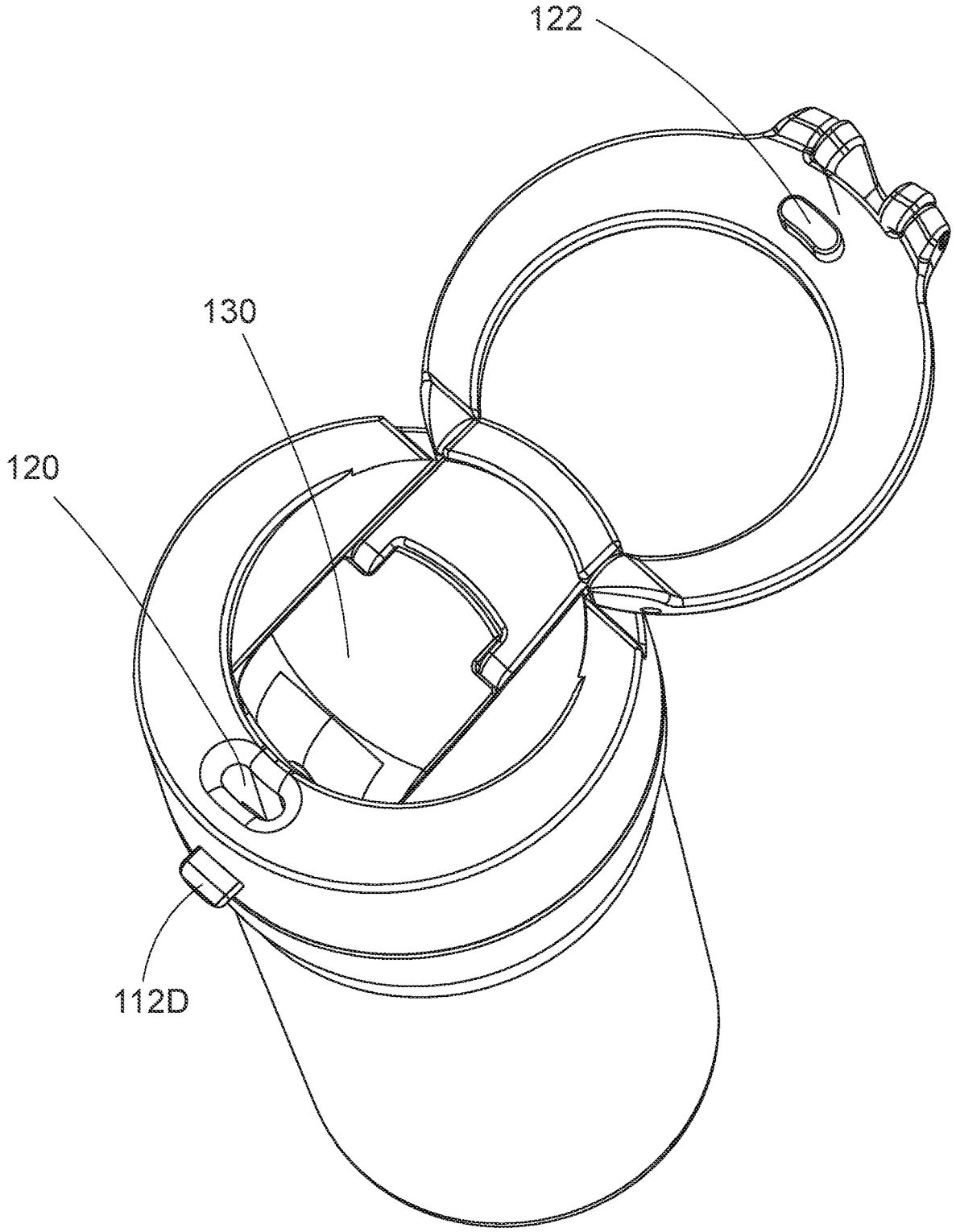
FIG. 4A illustrates an orifice of the first embodiment of the lid assembly.
Figure 4B:
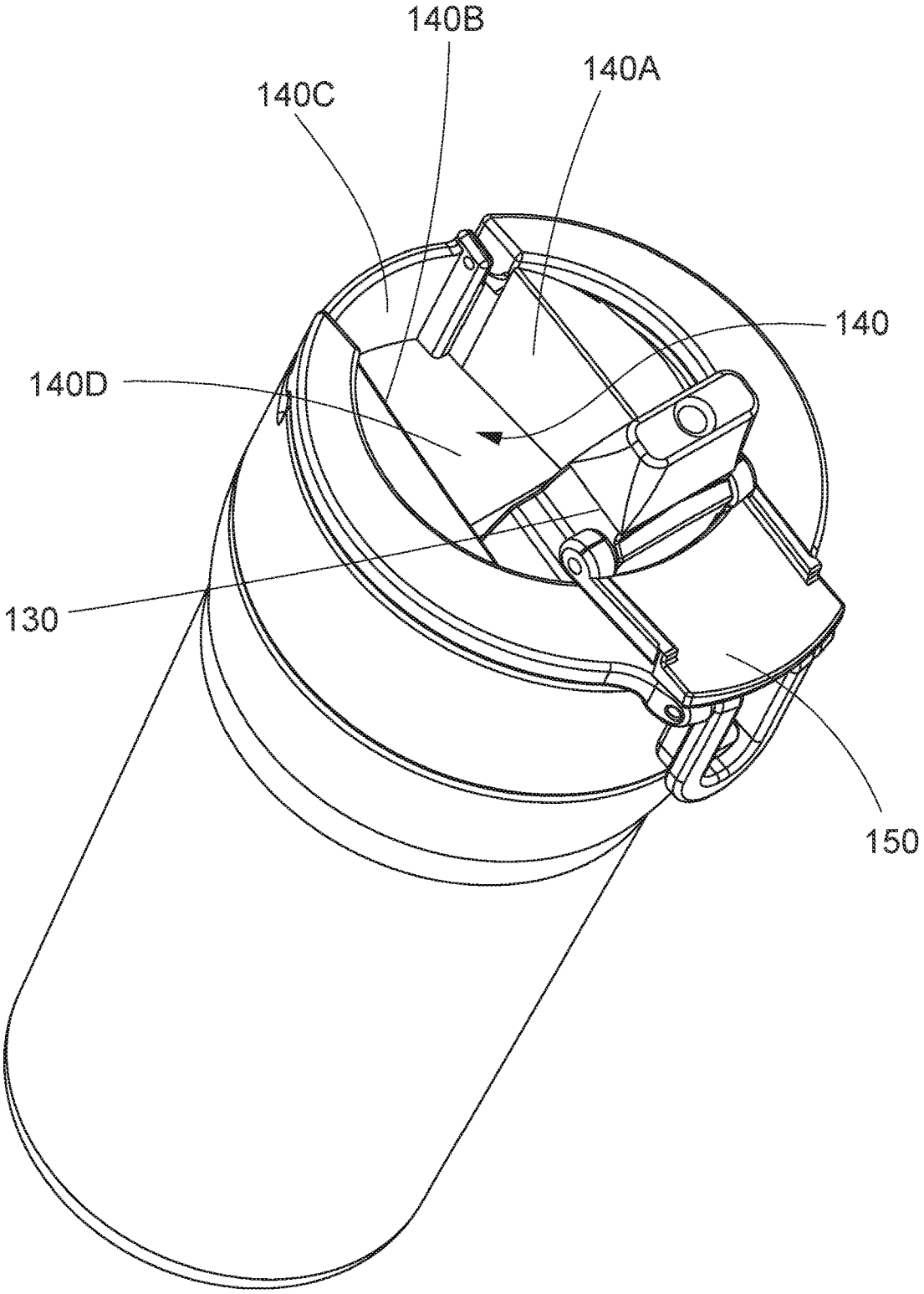
FIG. 4B illustrates a second spout of the first embodiment of the lid assembly.

Referring to FIGS. 4A-B, it can be seen that the spout 130 is receivable in a chamber 140 formed in the lid body 106. The chamber 140, for example, is defined by a pair of opposite internal walls 140A and 140B of the lid body 106 extending downwards from the upper surface of the lid body 106, the inner surface 140C of the vertical surrounding wall of the lid body 106, and inner surface 140D of the bottom of the lid body 106. By definition, "inner surface of the bottom of the lid body" in the context of this aspect of invention refers to the surface of the bottom of the lid body 106 facing away the internal cavity of the base member 102 when the lid assembly 104 is assembled to the base member 102; and "the inner surface of the vertical surrounding wall of the lid body" in the context of this aspect of invention refers to the inwardly surface of the surrounding wall of the lid body 106.

The chamber 140 is dimensioned fit to receive the spout 130. In other words, the shape of the chamber 140 corresponds to the shape of the spout 130. Still referring to FIG. 4B, as seen, the spout 130 is positioned inside the chamber 140 and is pivotably connected to the lid body 106. For example, the spout 130 is configured to pivotably connect to the pair of opposite internal walls 140A and 140B of the lid body 106 or to pivotably connect to the inner surface 140D of the bottom of the lid body 106. Accordingly, the spout 130 is adapted to assume a first configuration in which the spout 130 is received inside the chamber 140 or a second configuration in which the spout 130 erects substantially perpendicular with respect to the inner surface 140D of the bottom of the lid body 106.

Advantageously, as shown in FIGS. 3A-C, the spout 130, for example at its middle portion, is provided with a plate 150 pivotably connected thereat. When the spout 130 is received in the chamber 140 in its first configuration, the plate 150 covers the spout 130, preventing the spout 130 from contaminating from dust. When the spout 130 is received in the chamber 140 in its first configuration, the spout 130 is configured to be sealed or disengaged from the dispensing system by way of, for example, folding the tube in the dispensing system connecting between the spout 130 and the internal cavity of the base member 102 or disengaging the spout 130 from said tube. For brevity purpose, the means for sealing or disengagement is well understood by those skilled in the art and thus is not explained in details herein.

Advantageously, as shown in FIGS. 3C and 4A, it can be seen that when the lid body 106 is assembled to the base member 102, the lid body 106 is designed in that the height of the lid body 106 gradually increases from its one end adjacent the axles to its other end adjacent the orifice 120. The design of the lid body 106 provides an advantage that the orifice 120 is in a raised position, providing convenience to users to drink. Meanwhile, when the spout 130 is received in the chamber 140, the lower portion of the spout 130 and the plate 150 lie substantially flat, in particular advantageously lie substantially flat with the center portion of the upper surface of the lid body 106, as illustrated in FIGS. 3A-C. By definition, "the lower portion of the spout" in the context of this aspect of invention refers to the portion of the spout 130 uncovered by the plate 150, and is adjacent to the pivotal connection to the lid body 106. The middle portion of the spout 130 is provided with the plate 150 provides another advantage is that the plate 150 is act as a handle allowing users to pivotally move the spout 130 from its first configuration to its second configuration, thus users do not need to contact the spout 130 for movement by finger(s) or hand.

Figure 5:
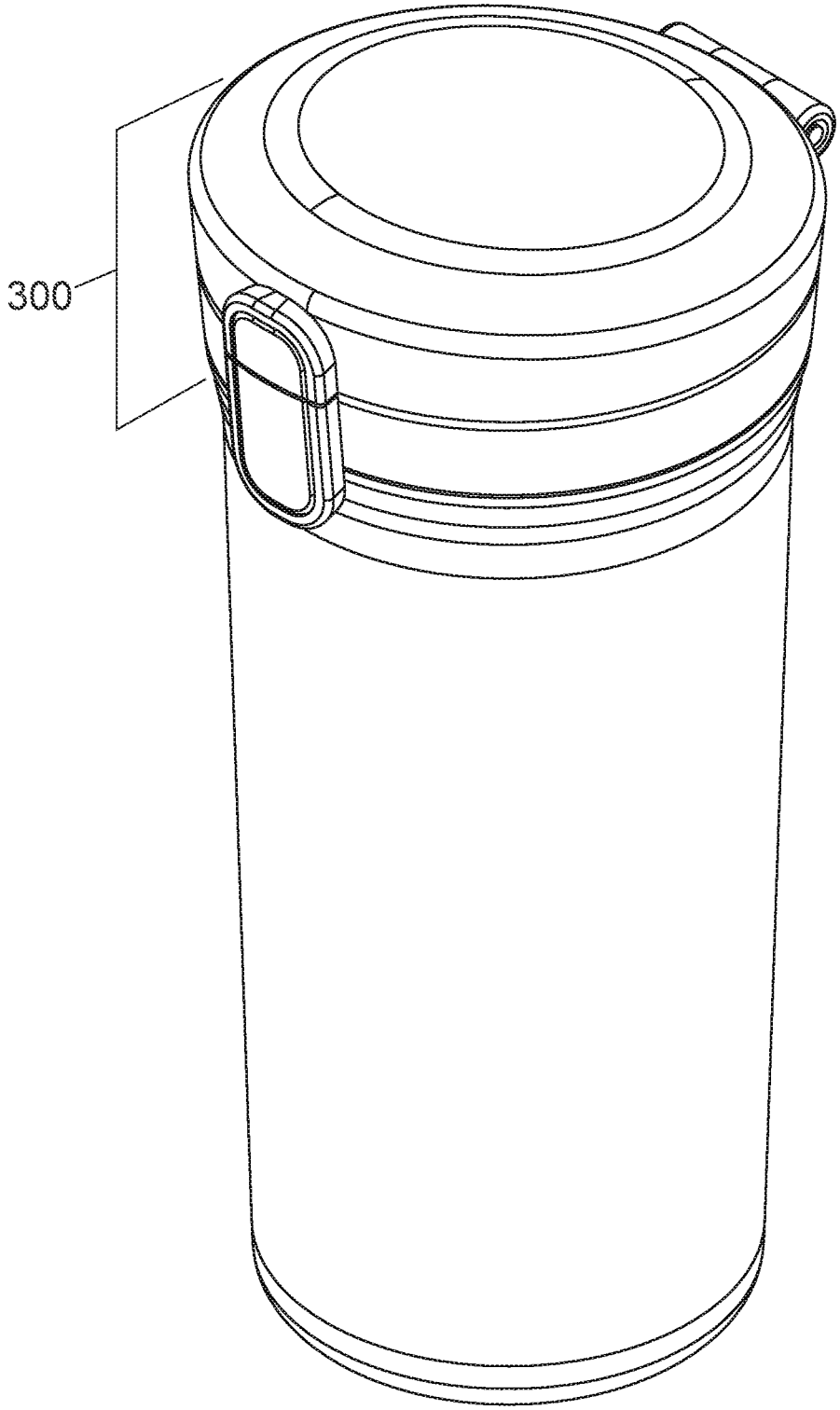
FIG. 5 illustrates a container with a second embodiment of the lid assembly of the present invention.

FIGS. 5-6 illustrate a second embodiment of the lid assembly of the present invention. It illustrates a beverage mug having a lid assembly 300 assembled to a base member. The lid assembly 300 has an outer lid 310, a middle lid 320 and an inner lid 330.

Figure 6A:
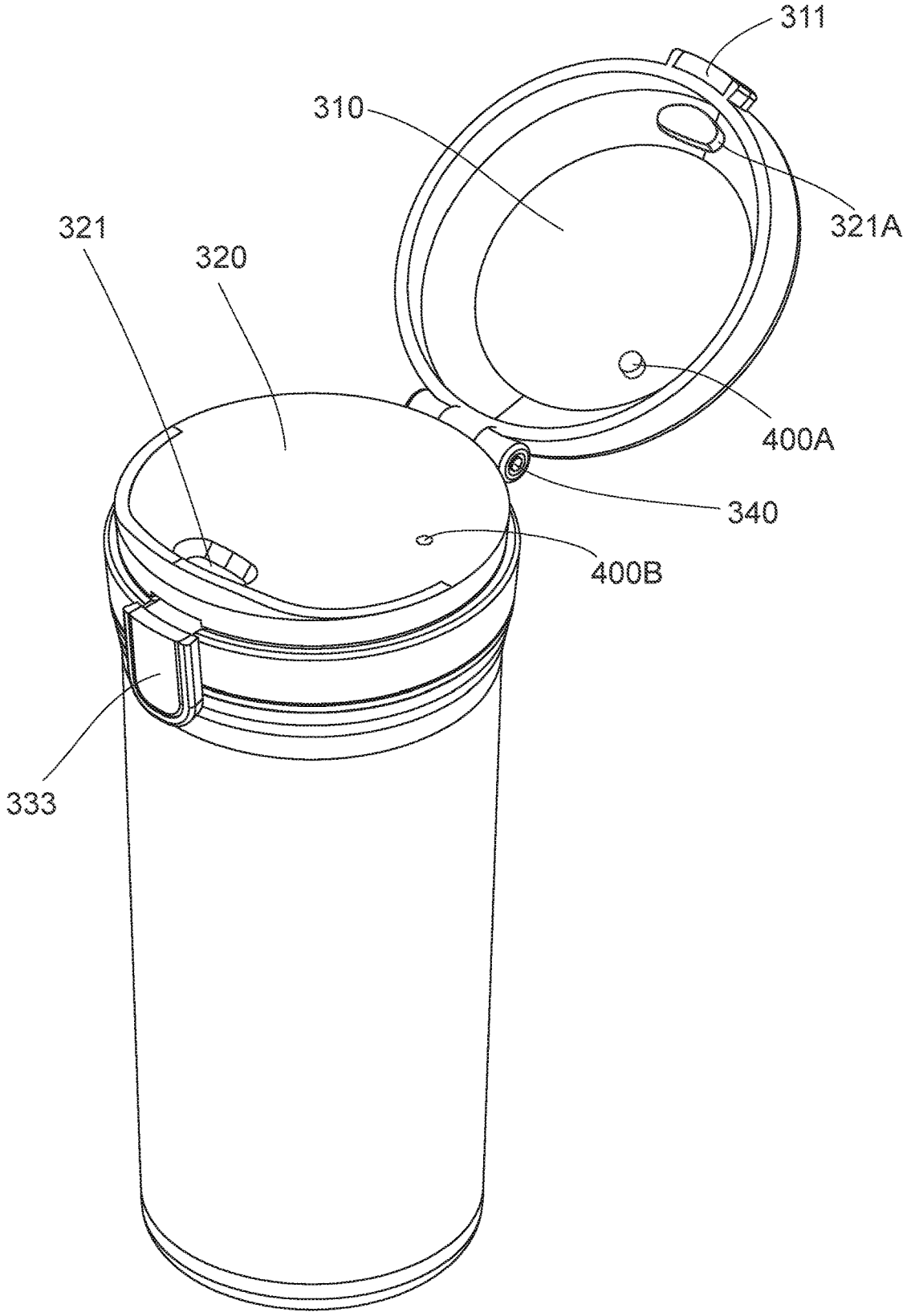
FIG. 6A illustrates a first spout of the second embodiment of the lid assembly.
Figure 6B:
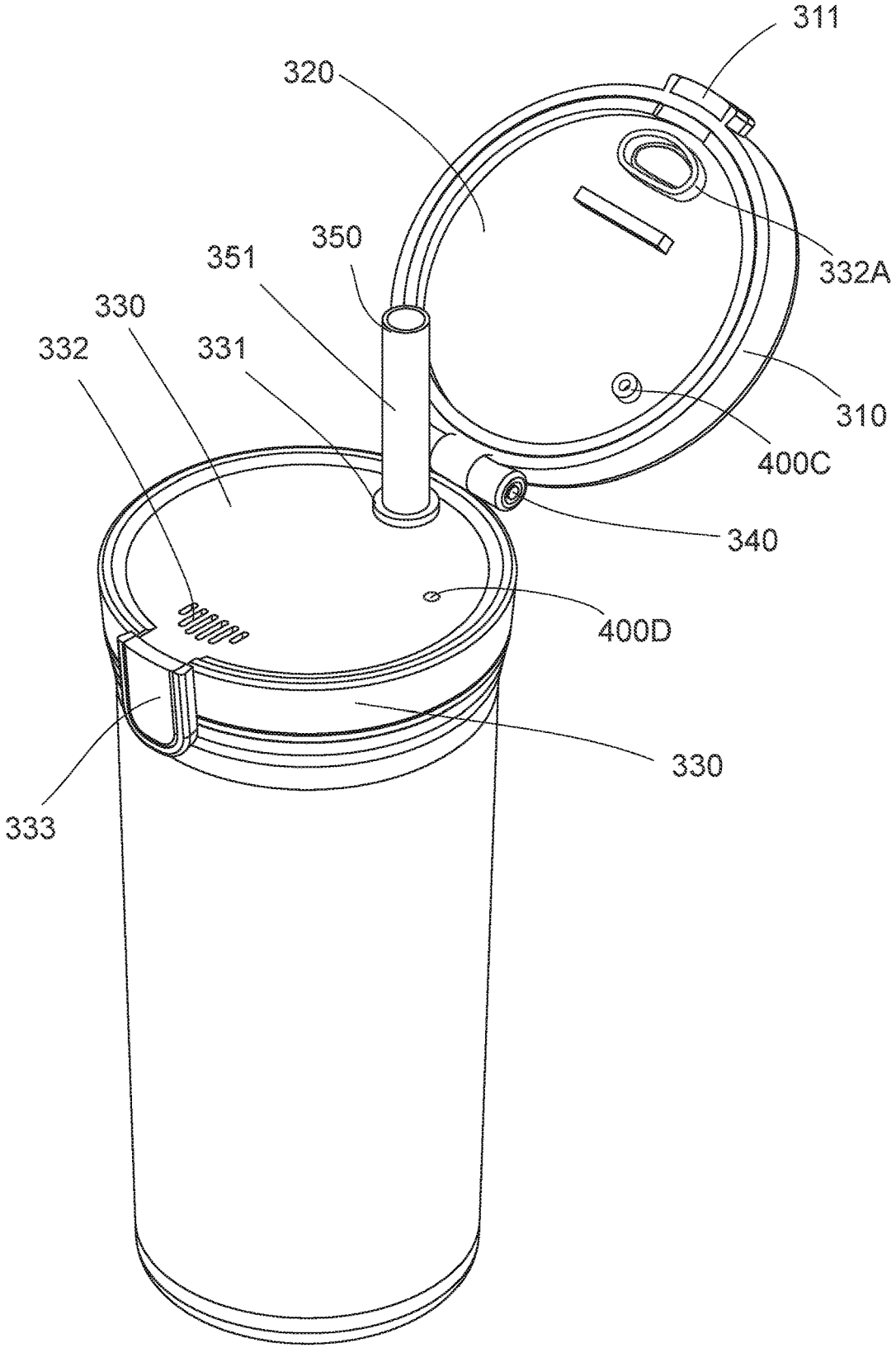
FIG. 6B illustrates a second spout of the second embodiment of the lid assembly.

FIG. 5 is the beverage mug in fully closed configuration and FIGS. 6A and 6B are the beverage mug in a first open configuration and a second open configuration, respectively.

A first drink orifice 321 is formed on the middle lid 320, and a second drink orifice 331 is formed on the inner lid 330. The first drink orifice 321 and the second drink orifice 331 are different from each other in diameter and/or shape and/or position. The outer lid 310 is configured to close the first drink orifice 321, and the middle lid 320 is configured to close the second drink orifice 331. The first and second orifices 321, 331 are positioned on two opposite sides of a diametric axis, such that the first drink orifice 321 is exposed to dispense the beverage while the second drink orifice 331 is disabled when the outer lid 310 is opened (see FIG. 6A); and the second drink orifice 331 is exposed to dispense the beverage while the first drink orifice 321 is disabled when the outer lid 210 and the middle lid 220 are opened (see FIG. 6B). By definition, "disabled" in the context of this aspect of invention refers to the orifice is not in use (or cannot be used) due to the respective lid is opened. A third drinking grid 332 is formed on the inner lid 330 and immediately underlying the first drink orifice 321, so that the beverage flows through the third drinking grid 332 into the first drink orifice 321.

Advantageously, as shown in FIG. 6A, the underside of the outer lid 310 is provided with a stopper 321A, preferably made by resilient material, which is sized and shaped fit to plug the first drink orifice 321 when the outer lid 310 is closed. It shall be understood that when the stopper 321A plugs to the first drink orifice 321, it prevent water leaks through the first drink orifice 321. More advantageously, as shown in FIG. 6B, the underside of the middle lid 320 is provided with a stopper 332A, preferably made by resilient material, which is sized and shaped fit to circulate around the third drinking grid 332 when the middle lid 320 is closed. It shall be understood that when the stopper 332A circulates around the third drinking grid 332, it prevent water leaks through the third drinking grid 321 thereby preventing the water spills over the inner lid 330.

Advantageously, as shown in FIGS. 6A and 6B, the lid assembly is provided with an operably closable air channel and is provided with a seal 400A and/or an air vent 400B and/or an aperture 400C and/or an air vent 400D. More advantageously, the aperture 400C is in air and fluid communication with the air vent 400B and the peripheral of the aperture 400C is encircled by resilient material being as a seal. The air channel provides an advantage that it facilitates the drinking by balancing the pressure between the ambient pressure and the pressure in the container. More advantageously, the air channel is always open when any of the first or second drinking orifice is in use.

Referring to FIG. 6A, it can be seen that the seal 400A is provided on the underside of the outer lid 310, preferably made by resilient material, and that the air vent 400B is provided to the middle lid 320. It shall be understood that the seal 400A is sized and shaped fit to plug the air vent 400B when the outer lid 310 is closed, thereby closing the air channel. In FIG. 6A, the air channel is defined by the air vent 400B and the air vent 400D.

Referring to FIG. 6B, it can be seen that the seal 400C is provided on the underside of the middle lid 320, preferably made by resilient material, and that the air vent 400D is provided to the inner lid 330. It shall be understood that the seal 400C is sized and shaped fit to sit over the air vent 400D when the middle lid 320 is closed. In FIG. 6A, the air channel is defined by the air vent 400D.

The lid assembly 300 has a pivot end and a latch end opposite to the pivot end. The outer lid 310 and the middle lid 320 are pivotably mounted on a side wall of the inner lid 330 at the pivot end through a hinge 340 as shown in FIGS. 6A and 6B. The outer lid 310 has a latch member 311 at the latch end of the lid assembly 300, and the latch member 311 is engageable with a side latch 333 formed on the side wall of the inner lid 330 to maintain the beverage mug in a closed configuration.

In one embodiment, the pivot end may be provided with a coil spring biasing the outer lid 310 and/or the middle lid 320, such that the outer lid 310 and/or the middle lid 320 operably and pivotably moves away or towards the inner lid 330 about the hinge 340.

The first drink orifice 321 and the second drink orifice 331 are of different dimensions and shapes to cater for different beverage consumption needs. For example, the first drink orifice 321 is shaped and sized to be an elongated slot for direct consumption by the user, while the second drink orifice 331 is shaped and sized to be a circular hole for insertion of a drink straw 350. The first drink orifice 221 and the second drink orifice 331 are spaced apart circumferentially and may be positioned adjacent to the periphery of the respective middle lid 320 and inner lid 330, and in fluid communication with the interior of the beverage mug.

In one embodiment, the lid assembly 300 can be provided with a drink straw 350 having a top section 351 that runs through and protrudes beyond the second drink orifice 331 and a low section that is disposed inwardly in contact with the beverage in the beverage mug. The top section 351 is foldable that can be folded down to lie against a recessed portion defined on the bottom surface of the middle lid 320 and is fully covered up by the middle lid 320, when the middle lid 320 remains to couple with the inner lid 330. In one embodiment, the top section 351 is foldable that can be folded down to lie against a recessed portion defined on the upper surface of the inner lid 330 and is fully received by the inner lid 330, when the middle lid 320 remains to couple with the inner lid 330.

In one embodiment, the lid assembly 300 has a lid latch at the latch end thereof, and the lid latch is engageable with a side latch formed on the side wall of the inner lid to maintain the beverage mug in a closed position. In this embodiment, the lid latch includes a first lid latch member provided on the outer lid and a second lid latch member provided on the middle lid. Correspondingly, the side latch includes a first side latch member and a second side latch member, which are respectively engageable with the first lid latch member and the second lid latch member to maintain the middle lid and the outer lid in a closed configuration, respectively. The outer lid is opened by disengaging the first lid latch member from the first side latch member; and the outer lid and the middle lid are both opened by disengaging the second lid latch member from the first side latch member.

In one embodiment, the lid assembly further includes a lock which is movable between a locked position where the disengagement of the lid latch from the side latch is prevented so as to lock the lid assembly in place, and an unlocked position where the disengagement of the lid latch from the side latch is allowed to open the outer lid and the middle lid as desirable.

It shall be understood that certain features of the invention, which are, for clarity, described in the content of separate embodiments, may be provided in combination in a single embodiment. Conversely, various features of the invention which are, for brevity, described in the content of a single embodiment, may be provided separately or in any appropriate sub-combinations. Also, a skilled person in the art would be aware of the prior art which is not explained in the above for brevity purpose. It is to be noted that certain features of the embodiments are illustrated by way of non-limiting examples. For example, the size and shape and position of the disclosed components can be adaptively changed to cater different users' need. The disclosed components are all examples to illustrate the present invention only and shall not construe as limiting to the scope of protection. Those skilled in the art could adjust and/or modify these components according to actual needs, and variations therefrom also fall into the scope of the present invention.

What is claimed is:

1. A lid assembly, for a container, comprising:

a) a first lid member; and b) a second lid member, positioned below said first lid member and comprising a lower lid contacting said container and an upper lid positioned below said first lid member and above said lower lid, wherein said second lid member is provided with:

a first drinking means in direct fluid communication with the beverage in said container via a first fluid passageway, wherein said first drinking means is provided on said upper lid, and said first lid member is pivotably connected to said second lid member at a hinge to assume a first position where said first drinking means being covered by said first lid member and a second position where said first drinking means being exposed;

a second drinking means provided with a drinking tube in fluid communication with the beverage in said container via a second fluid passageway, wherein said second drinking means is configured to operationally enable said second fluid passageway; and characterized in that the use of said first drinking means and the use of said second drinking means is mutually exclusive and independent of each other; and said first fluid passageway and said second fluid passageway are independent of each other.

2. The lid assembly as claimed in claim 1, wherein:

said second drinking means is provided on said lower lid; and said upper lid pivotably connecting said lower lid to assume a first position where said second drinking means being covered by said upper lid and a second position where said second drinking means being exposed.

3. The lid assembly as claimed in claim 2, wherein said lower lid is provided with a drinking grid thereon, the position of said drinking grid is positioned underlying the position of said first drinking means when said upper lid covering said lower lid.

4. The lid assembly as claimed in claim 2, wherein said lid assembly is provided with a hinge mechanism on the side wall of said lower lid, on which said first lid member and said upper lid are respectively mounted pivotably.

5. The lid assembly as claimed in claim 4, wherein said hinge mechanism comprising a coil spring.

6. The lid assembly as claimed in claim 4, wherein said lid assembly is provided with a lock mechanism with which said hinge mechanism collaborating for controlling the pivotable movement of said first lid member and said upper lid.

7. The lid assembly as claimed in claim 6, wherein said lock mechanism comprising:

a) a lid latch having:

a first lid latch member provided on said first lid member; and a second lid latch member provided on said upper lid;

b) a side latch having:

a first side latch member and a second side latch member provided on the side wall of said lower lid; and characterized in that, said first side latch member engaging with said first lid latch member to close said upper lid;

said second side latch member engaging with said second lid latch member to close said first lid member;

said first lid member is opened by disengaging said first lid latch member from said first side latch member; and said first lid member and said upper lid are both opened by disengaging said second lid latch member from said first side latch member.

8. The lid assembly as claimed in claim 7, wherein said lock mechanism movable between a locked position where disengagement of said lid latch from the side latch is prevented, and an unlocked position where the disengagement of said lid latch from said side latch is allowed to open said first lid member and said upper lid.

9. The lid assembly as claimed in claim 3, said drinking tube extending through said second drinking means defining an upper portion of said drinking tube outwardly exposed and a lower portion of said drinking tube inwardly disposed in contact with the beverage in said container, wherein said upper portion is bendable, characterized in that, the bottom surface of said upper lid is provided with a recessed region sized and shaped to receive said upper portion of said drinking tube when said upper lid is at its first position; and/or the upper surface of said lower lid is provided with a recessed region sized and shaped to receive said upper portion of drinking tube when said upper lid is at its first position.

10. The lid assembly as claimed in claim 1, wherein said second drinking means is pivotably connected to said second lid member, thereby said second drinking means is configured to assume:

a first configuration in which said second drinking means is positioned to block said second fluid passageway; or a second configuration in which said second drinking means is positioned to enable said second fluid passageway.

11. The lid assembly as claimed in claim 10, in said first configuration, said second drinking means is received in a chamber recessed from the upper surface of said second lid member.

12. The lid assembly as claimed in claim 11, said chamber is dimensioned fit to receive said second drinking means, said chamber is formed by:

a pair of opposite internal walls extending downwards from the upper surface of said second lid member;

a portion of the surrounding wall of said second lid member, and a portion of the bottom of said second lid member.

13. The lid assembly as claimed in claim 1, said lid assembly is provided with a hinge mechanism allowing said first lid member pivotably moving between said first position and said second position.

14. The lid assembly as claimed in claim 13, wherein said lid assembly is provided with a lock mechanism with which said hinge mechanism collaborating for controlling the pivotable movement of said first lid member.

15. The lid assembly as claimed in claim 14, said hinge mechanism is an axle passing through a groove and an aperture, wherein:

said groove is formed in a standing wall of a recessed region on a part of the perimeter of the top surface of said second lid member; and said aperture is formed in two opposite free ends of an arcuate notch of said first lid member profiled in a ring shape having said arcuate notch.

16. The lid assembly as claimed in claim 2, wherein said first lid member profiled in a ring shape, such that a user can use said second drinking means without the need to open said first lid member.

17. The lid assembly as claimed in claim 13, wherein:

said second lid member is designed in that the height of said second lid member gradually increases from its one end adjacent said hinge mechanism to its other end adjacent said first drinking means, thereby said first drinking means is in a position higher than said hinge mechanism.

18. The lid assembly as claimed in claim 10, wherein said second drinking means is provided with a handle allowing users to pivotally move said second drinking means from said first configuration to said second configuration.

19. The lid assembly as claimed in claim 18, wherein said handle covering said second drinking means when said second drinking means is in said first configuration.

* * * * *